United States Patent [19]

Daniels

[11] 4,035,988

[45] July 19, 1977

[54] VACUUM POCKET-OPENING TURRET

[75] Inventor: David Daniels, Jacksonville, Fla.

[73] Assignee: General Foods Corporation, White Plains, N.Y.

[21] Appl. No.: 693,024

[22] Filed: June 4, 1976

[51] Int. Cl.[2] ..... B65B 1/02; B65B 43/30

[52] U.S. Cl. ..... 53/183; 53/187; 53/386

[58] Field of Search ..... 53/183, 187, 386

[56] References Cited

U.S. PATENT DOCUMENTS

| | | | |
|---|---|---|---|
| 2,333,571 | 11/1943 | Hohl et al. | 53/386 X |
| 3,821,873 | 7/1974 | Brenner et al. | 53/183 X |

*Primary Examiner*—Travis S. McGehee

*Attorney, Agent, or Firm*—Thomas R. Savoie; Daniel J. Donovan; Bruno P. Struzzi

[57] ABSTRACT

A rotating turrent equipped with a plurality of spring-biased, reciprocating vacuum nozzles is employed in conjunction with a packaging machine which forms packages from strip stock. The reciprocating nozzles are rotated about a stationary cam which sequentially thrusts the nozzles out into engagement with the outer sidewall of a strip of U-shaped stock material which has been formed into a series of longitudinally-spaced pockets and which strip is positively secured to a filling station at its other sidewall by suction means. The spring-biased vacuum nozzle is then retracted in order to effect separation of the top edges of the sidewalls and permit filling of the pocket with a granular material.

3 Claims, 4 Drawing Figures

VACUUM POCKET-OPENING TURRET

BACKGROUND OF THE INVENTION

This invention relates to an improved means for effecting the opening of pockets formed in a continuous strip of folded or U-shaped stock material provided with spaced-apart vertical heat seals.

Apparatus for the manufacture of sealed packages from strip stock are well-known in the art as illustrated by U.S. Pat. Nos. 3,453,799, 3,478,492 and 3,563,001 to Cloud et al. all of which are herein incorporated by reference. This type of equipment is suitable for the continuous production of a series of filled packages from a continuous length of heat-sealable flexible material; preferably a plastic coated paper or foil.

In operation, a continuous length of strip stock is drawn through a guide or strip plow where it is folded into a generally U-shaped configuration, the fold being disposed at the bottom and the strip edges disposed at the top. The folded strip is then passed through a sealing station where longitudinally-spaced, vertically-extending heat seals are made across the entire height of the strip. In this manner pockets are formed, each pocket being disposed between a pair of vertically-extending heat seals which adhere the pocket sidewalls. After the strip has been sealed in the manner described, it is moved to a filling station where a granular material, in the desired amount, is inserted into each pocket.

Typically the filling station, as shown in the aforementioned patents, consists of a rotating turret provided with a plurality of collapsible suction heads disposed at circumferentially spaced intervals about the perimeter of the wheel, an overhead rotation filling drum equipped with a plurality of discharge tubes or funnels and an overhead air nozzle. In operation the continuous strip of pockets is fed to the rotating turret at a rate whereby each pocket engages a separate suction head and is positioned directly beneath a separate discharge tube. Vacuum is applied to the collapsible suction head to cause a collapse or retraction of the head thereby pulling the inwardly-facing sidewall of the pocket back and away from the outwardly-facing sidewall. In this manner the pocket should be opened to permit filling. It has been found, however, that when employing lightweight films as the stock material, it is necessary to provide additional means to assist in opening the pockets prior to filling. The three aforementiond patents each disclose the use of an overhead nozzle for providing a continuous stream of air to spread the top edges of the sidewalls. The filling tube may then be lowered down into the opened pocket to discharge the desired amount of granular material and then withdrawn.

After filling, the strip of filled pockets is delivered from the rotating wheel of the filling station to cutoff and sealing stations. The individual sealed pockets or pouches may then be stacked and packaged as desired.

SUMMARY OF THE INVENTION

It has been found that when employing the packaging equipment disclosed in the patents to Cloud et al., and as discussed above, the noise level in the vicinity of the equipment is undesirably high. It has also been discovered that when the packaging equipment is operated with the air nozzle shut off, the noise level declines to an acceptable value.

It is an object of this invention to provide a mechanism for ensuring that the top edges of the preformed pockets are spread to permit filling, while maintaining the maount of noise emanating from the filling station of the packaging line at an acceptable level. This is accomplished by means of a novel vacuum pocket-opening turret which operates in conjunction with the above-described packaging equipment.

According to the present invention, the continuous strip of preformed pockets is fed to the filling station and into engagement with the collapsible suction heads of the rotating turret as previously described. After the inwardly-facing sidewall of the pockets are positively secured to the suction head by means of connecting the suction head to a source of vacuum, the outwardly-facing sidewall of the pocket is contacted with a spring-biased, reciprocating vacuum nozzle. As the pockets approach the point at which filling is initiated, the vacuum nozzle is pulled back away from the suction heads of the rotating turret, thereby ensuring pocket opening.

Figure 1:
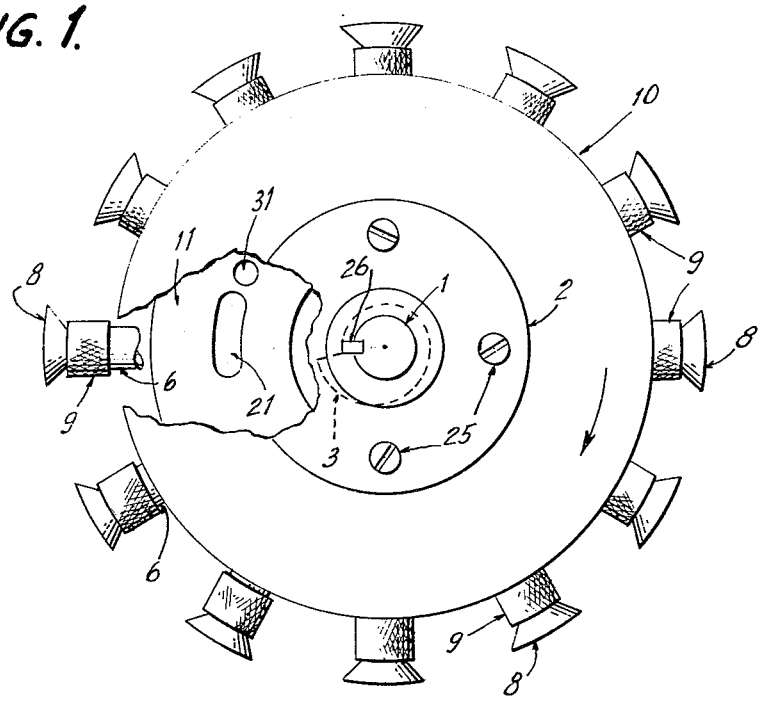
FIG. 1 depicts a top plan view of the vacuum pocket-opening turret of this invention.

DESCRIPTION OF THE INVENTION for definiteness of disclosure, the invention will be described in conjunction with the specific embodiment shown in the drawings. It should be understood, however, that the principles of the invention may be employed in other embodiments.

Referring to FIG. 1, there is depicted a plan view of the vacuum pouch opening turret, including a drive shaft 1, which by means of drive hub 2 turns turret housing 10 which carries around its periphery a plurality of equally-spaced spring-biased plunger tubes 6 connected at their outer ends to suction cups 8 by means of retaining nuts 9. As can be seen from the Figure, the suction cups, each in turn as the turret rotates, begin their outward projection at the three o'clock position and continue this movement through the nine o'clock position after which point it is abruptly returned to the retracted position.

Figure 2:
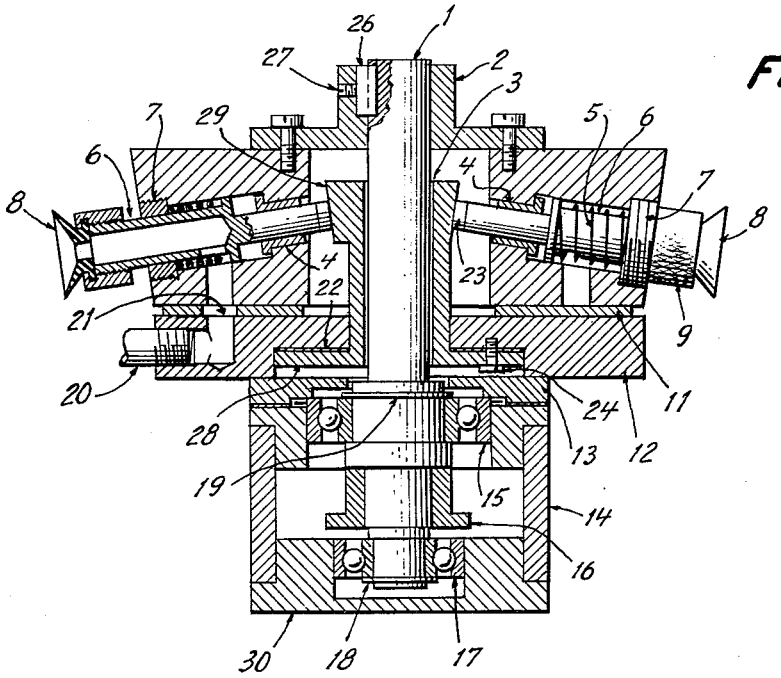
FIG. 2 is a side view, in section, of the vacuum pocket-opening turret, as viewed on the line II—II.

FIG. 2 illustrates the high and low sections of stationary cam 3 about which plungers 6 rotate. Each plunger is positioned within the rotating housing 10 by means of a rear flanged bushing 4, a threaded front bushing 7 and a plunger return spring 5. As shown in the Figure, housing 10 is rotated by means of drive hub 2 which is secured to the housing by means of retaining bolts 25. The hub 2 is driven by drive shaft 1 through key 26 which is retained in place by means of set screw 27. Housing 10 rotates on a stationary vacuum shoe 12, the top surface of which is provided with a low-friction wear strip 11. The vacuum shoe provides the plunger tubes 6 with access to a vacuum source 20 through vacuum passageway 21 located at the position (nine o'clock FIG. 1) where plunger 6 is at its maximum extension and suction cup 8 is in contact with the outwardly-facing sidewall of the strip pocket which is desired to be opened. Vacuum shoe 12 may also be provided with a passageway or port 31 which leads to the atmosphere and which will ensure release of the sidewall from suction cup 8.

Vacuum shoe 12 is secured to cam 3 by means of bolts 24 and the horizontal contact surface between the cam flange 28, and the vacuum shoe is provided with shims 22 capable of adjusting the length of the plunger stroke by varying the point at which the plunger wear tip 23 contacts the inclined cam face 29. The vacuum shoe 12 is supported by a bearing drive housing 30 comprised of bearing retainer flange 13 and housing sideplate 14 and which housing contains ball bearings 15 and 17, drive sprocket 16 and bearing retainer rings 18 and 19. The drive sprocket may be connected through suitable drive chain means to a motor (not shown) which rotate the housing 10 and plungers 6 at a speed synchronized with the passage of a strip of continuous stock material at the nine o'clock position of FIG. 1.

Figure 3:
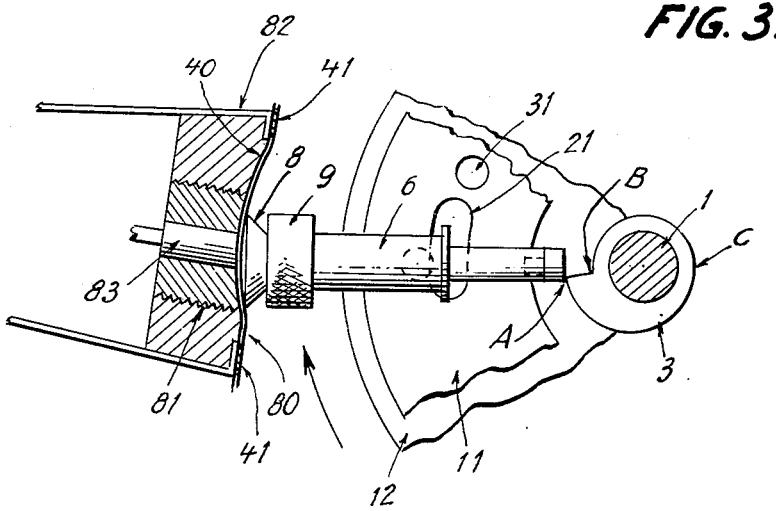
FIGS. 3 and 4 are sequential, top fragmentary views of the pocket-opening turret operating in combination with the rotating turret of the filling station.
Figure 4:
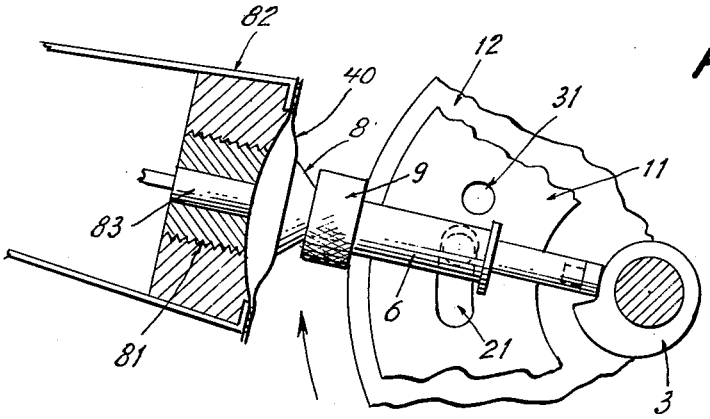

FIG. 3 illustrates the present invention in operation with the plunger 6 at its maximum extension (corresponding to the nine o'clock position on FIG. 1), and with suction cup 8 in contact with the strip pocket 40 and in communication with the vacuum source (not shown) through vacuum port 21. The strip pocket, which is one of a series of spaced-apart, vertically-extending pockets in a continuous strip of U-shaped stock material, each pocket being defined by a pair of vertical heat seals 41, is secured at its inwardly-facing sidewall to one of the collapsible suction heads 81 which, as described previously, are circumferentially-spaced about the perimeter of a rotating turret 80 which constitutes part of the filling station of the well-known Cloud-type packaging machines. The strip is positioned on turret 80 in such a manner that the vertical seals 41 are aligned with essentially-vertical, spaced lands 82 and the strip is held in position on turret 80 by means of vacuum nozzle 83 which is connected to a source of vacuum (not shown). The plunger tip 23 is depicted in FIG. 3 as being on the high cam at point A of its rotation about stationary cam 3 and immediately before the plunger drops onto the low cam at position B (as shown in FIG. 4). As the plunger continues to rotate about the stationary cam, it is maintained in a fully retracted position until point C (corresponding to three o'clock on FIG. 1) where the plunger begins and continues to extend around 180° of its rotation, by virtue of the cam profile.

As the plunger drops off the high cam and suction cup 8 is withdrawn from the collapsible suction head 81 of the filling station turret 80, the outwardly-facing sidewall of the strip pocket, which is attached to the cup 8 by means of vacuum, is also drawn away from suction head 81. As a result, as shown in FIG. 4, the pocket is opened along the top edges of the sidewalls and is ready for insertion of the desired amount of such granulated materials as soluble coffee powder, sugar, powdered non-dairy creamer, etc.

It will, of course, be apparent to those skilled in the art that suitable well-known techniques must be employed in order to operate the vacuum pocket-opening turret of this invention in synchronization with the filling station turret of the Cloud or other types of packaging machines. It would, of course, be possible to match both the dimensions and number of suction heads or vacuum nozzles of the filling station turret and pocket-opening turret and to use a common drive means for rotating both turrets at equal speeds. It may be desirable, however, to conserve both space and capital by employing only half as many vacuum nozzles as there are suction heads and rotating the pouch-opening turret at twice the speed of the filling turret.

Use of the invention described herein has been found to materially reduce noise levels and otherwise improve conditions in and around Cloud-type packaging lines.

Having thus described the invention, what is claimed is:

1. In an apparatus for continuously forming sealed packages including:

a. means for feeding a strip material having a U-shaped configuration, b. means for forming spaced pockets along the length of the strip material leaving the top edges of the pocket sidewalls unsealed, c. a filling station having a rotating turret and an overhead rotating filling drum equipped with a plurality of discharge tubes, said turret provided with a plurality of circumferentially-spaced collapsible suction heads about its periphery said heads being for engagement with a first outer sidewall of said pockets, and d. means for sequentially collapsing said suction heads and withdrawing the pocket sidewall with which the collapsed head is engaged, the improvement comprising, a rotating pocket-opening turret provided around its periphery with a plurality of circumferentially-spaced, spring-biased, reciprocating vacuum nozzles rotating about a stationary cam which cam has a cam face which is inclined from the vertical and which cam sequentially thrusts the vacuum nozzles out into engagement with the second outer sidewall of said pocket while said vacuum nozzle is in communication with a vacuum source and while said first sidewall is engaged with said collapsible suction head and which cam permits abrupt withdrawal of the vacuum nozzle while it is still engaged with said second sidewall in order to effect separation of the top edges of the pocket sidewalls prior to filling the pocket with a granular material and thereafter, placing the vacuum nozzle in communication with a passageway leading to the atmosphere in order to release said sidewall from the vacuum nozzle.

2. The apparatus of claim 1 wherein the vacuum nozzles are gradually thrust out around 180° of the cam profile.

3. The apparatus of claim 1 wherein the number of collapsible heads on the filling station turret is equal to the number of vacuum nozzles on the pocket-opening turret.

* * * * *